United States Patent [19]

Ueno et al.

[11] Patent Number: 4,726,415

[45] Date of Patent: Feb. 23, 1988

[54] APPARATUS FOR PRODUCING COMPOUND MATERIAL

[75] Inventors: Toyoaki Ueno; Hisateru Ohkusa, both of Yamaguchi, Japan

[73] Assignee: Ube Industries, Ltd., Ube, Japan

[21] Appl. No.: 54,074

[22] Filed: May 21, 1987

Related U.S. Application Data

[63] Continuation of Ser. No. 813,030, Dec. 24, 1985, abandoned.

[30] Foreign Application Priority Data

Dec. 28, 1984 [JP] Japan ..... 59-276811

[51] Int. Cl.[4] ..... B22D 17/14; B22D 17/24

[52] U.S. Cl. ..... 164/253; 164/312; 164/332; 164/343; 164/338.1

[58] Field of Search ..... 164/97, 98, 103, 105, 164/112, 120, 332, 253, 254, 256, 342, 343, 303, 312, 338.1

[56] References Cited

U.S. PATENT DOCUMENTS

| | | | |
|---|---|---|---|
| 2,065,213 | 12/1936 | Dolan et al. | 164/332 |
| 2,953,826 | 9/1960 | Larsh | 164/112 |
| 3,826,302 | 7/1974 | Wunder | 164/332 |
| 3,913,657 | 10/1975 | Banker et al. | 164/332 |
| 4,286,648 | 9/1981 | Takeshima et al. | 164/312 |
| 4,287,935 | 9/1981 | Ueno et al. | 164/312 |
| 4,431,047 | 2/1984 | Takeshima et al. | 164/253 |
| 4,489,771 | 12/1984 | Takeshima et al. | 164/305 |
| 4,505,307 | 3/1985 | Uchida | 164/457 |

FOREIGN PATENT DOCUMENTS 58-221244 12/1983 Japan .

*Primary Examiner*—Nicholas P. Godici
*Assistant Examiner*—Richard K. Seidel
*Attorney, Agent, or Firm*—Blakely, Sokoloff, Taylor & Zafman

[57] ABSTRACT

An apparatus for producing a compound material such as a fiber reinforced metal comprises a first retaining chamber into which molten matrix metal e.g. aluminum etc. is introduced, a plunger for applying a pressure to the molten matrix metal positioned below the first retaining chamber, a second retaining chamber adapted to receive reinforcement materials e.g. fibrous ceramics called "whisker", the second retaining chamber being in vertical alignment with the first retaining chamber so as to communicate therewith, a clamping device positioned above the second retaining chamber and supported movably in a vertical direction, and heating means provided in the first and second retaining chambers. The apparatus thus configured makes it possible to easily impregnate the molten matrix metal into space between the reinforcement materials, thus producing a reinforced compound material with high quality.

10 Claims, 9 Drawing Figures

APPARATUS FOR PRODUCING COMPOUND MATERIAL

This is a continuation of application Ser. No. 813,030 filed Dec. 24, 1985, now abandoned.

BACKGROUND OF THE INVENTION

The present invention relates to an apparatus for producing a reinforced compound material with high quality.

Ceramics are produced by preparing a material containing oxide or nitride of silicon, aluminum or titanium etc. as its major component, adding a caking material e.g. nickle, chromium, glass, or cement etc. to the major material, and sintering a resulting material. Ceramics have a high melting point, an excellent heat-resisting property, and high hardness and strength. Because of such properties, ceramics are used for engine parts of an air plane or blades of a high speed turbine. However, the ceramics are not necessarily acceptable in respect of anti-shock property etc.

Further, it has been practice that powdered ceramics, not yet subjected to sintering, are molten or added with water to become a slurry, and sprayed to coat a metal surface. The ceramic coated metal thus obtained is also superior to the conventional heat-resisting alloy in respect of mechanical property at high temperatures. Because of such an excellent property, the ceramic coated metal is used for a combustion chamber of an engine or the like but is likely to be oxidized at a high temperature and its use is limited.

As stated above, ceramics have excellent properties, but no attempt has been made to use ceramics for improving strength of metal and utilization and development of ceramic to this end have been desired. In view of this, considering that reinforcement materials such as fibrous ceramics before sintering called "whisker" or spherical ceramics are formed into a porous body of low density and impregnated with molten metal, the inventors of this application have earnestly carried out many studies and succeeded in developing a novel apparatus for impregnating molten metal.

Other prior art of this kind will be described. For example, U.S. Pat. No. 4,286,648 or U.S. Pat. No. 4,287,935 teaches a vertical die casting machine wherein the lower casting sleeve is normally held in vertical alignment with the upper casting sleeve but is inclined to a position lateral to the stationary platen for receiving the molten metal. U.S. Pat. No. 4,431,047 or U.S. Pat. No. 4,489,771 teaches a gas evacuating device for a metal mold provided with a valve mechanism which is automatically closed by making use of inertia force given by the injected molten material. Further, Japanese Patent Application Laid-open No. 58-221244 discloses an apparatus for producing a compound material provided with pressure reducing means, thus reducing a pressure within a chamber for receiving reinforcement material, thereafter solidifying molten matrix metal while applying a pressure thereto. In addition, Japanese Patent Application Laid-open No. 59-136437 teaches a method of producing fiber reinforced metal comprising the steps of heating reinforcement fibers retained within a cast at a temperature lower than a melting point of molten matrix metal, pouring the hot molten metal into the cast, and impregnating the hot molten metal into the space between the reinforcement fibers by applying a pressure to the hot molten metal, thus solidifying the hot molten metal with the pressure being applied thereto.

As understood from the following description, the above-mentioned prior arts only constitute partial features of the novel apparatus according to the present invention, failing to obtain various advantageous effects of the present invention.

SUMMARY OF THE INVENTION

Accordingly, an object of the present invention is to provide an apparatus for producing a compound material which can firmly integrate metal e.g. aluminum etc. with high performance non-molten material e.g. ceramics etc. serving as a reinforcement material, thus improving strength or heat-resisting property etc. of the compound material produced.

Another object of the present invention is to provide a simplified apparatus for producing a compound material which can provide products of uniform strength with high productivity.

According to the present invention, there is provided an apparatus for producing a compound material comprising: a first retaining chamber into which molten matrix metal is introduced; a pressure applying plunger positioned below the first retaining chamber for applying a pressure to the molten matrix metal introduced within the first retaining chamber; a second retaining chamber adapted to receive a reinforcement material in the form of a porous body of low density, the second retaining chamber being positioned above the first retaining chamber and in vertical alignment therewith so as to communicate with the first retaining chamber; a clamping device positioned above the second retaining chamber and supported movably in a vertical direction, and heating means provided in the first and second retaining chambers. Preferably, the reinforcement material consists of fibrous ceramics or spherical ceramics.

With the apparatus thus configured, the second retaining chamber within which the porous reinforcement material body is received is moved for alignment with the first retaining chamber and engages the first retaining chamber to which the molten matrix metal has been charged, the second retaining chamber thus engaged is clamped by means of the clamping device from above, both the chambers are heated, and a relative pressure is applied to the reinforcement material within the second retaining chamber and the molten matrix metal within the first retaining chamber by a pressure applying cylinder or a pressure reduction device, alone or cooperation of both, whereby the molten metal is impregnated into the porous reinforcement material body, thus producing an excellent compound material.

BRIEF DESCRIPTION OF THE DRAWINGS

The features and advantages of an apparatus for producing a compound material according to the present invention will become more apparent from the following description taken in conjunction with the accompanying drawings, in which.

DESCRIPTION OF THE PREFERRED EMBODIMENT

Figure 1:
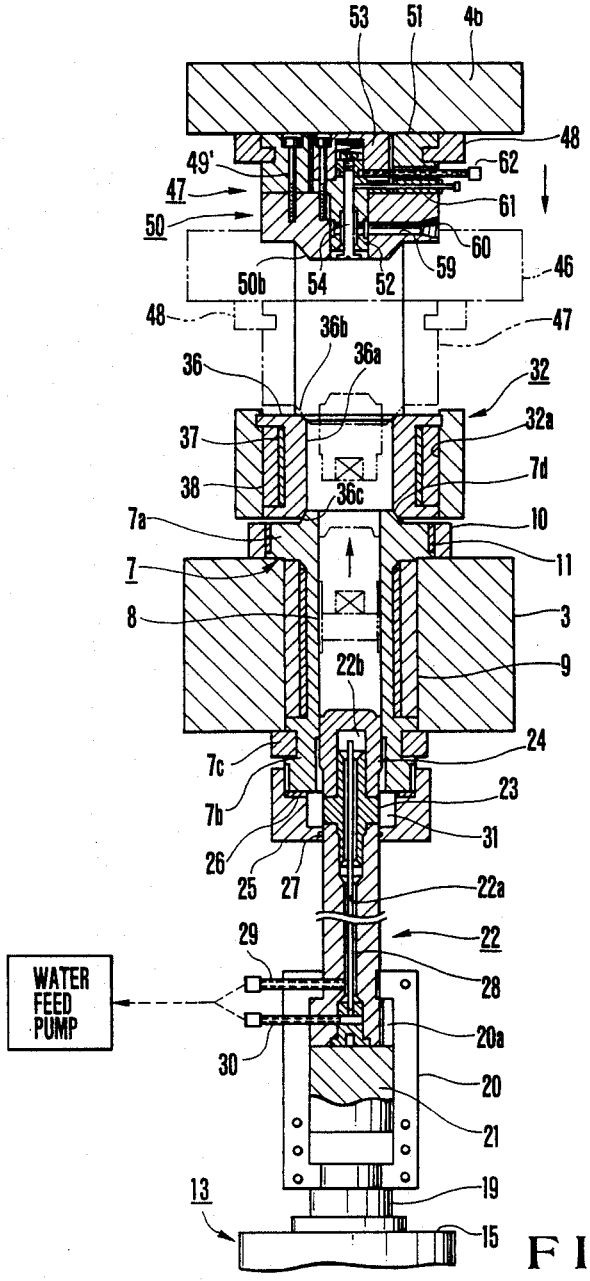
FIG. 1 is a longitudinal sectional view illustrating an essential part of an apparatus for producing a compound mterial according to an embodiment of the present invention.
Figure 2:
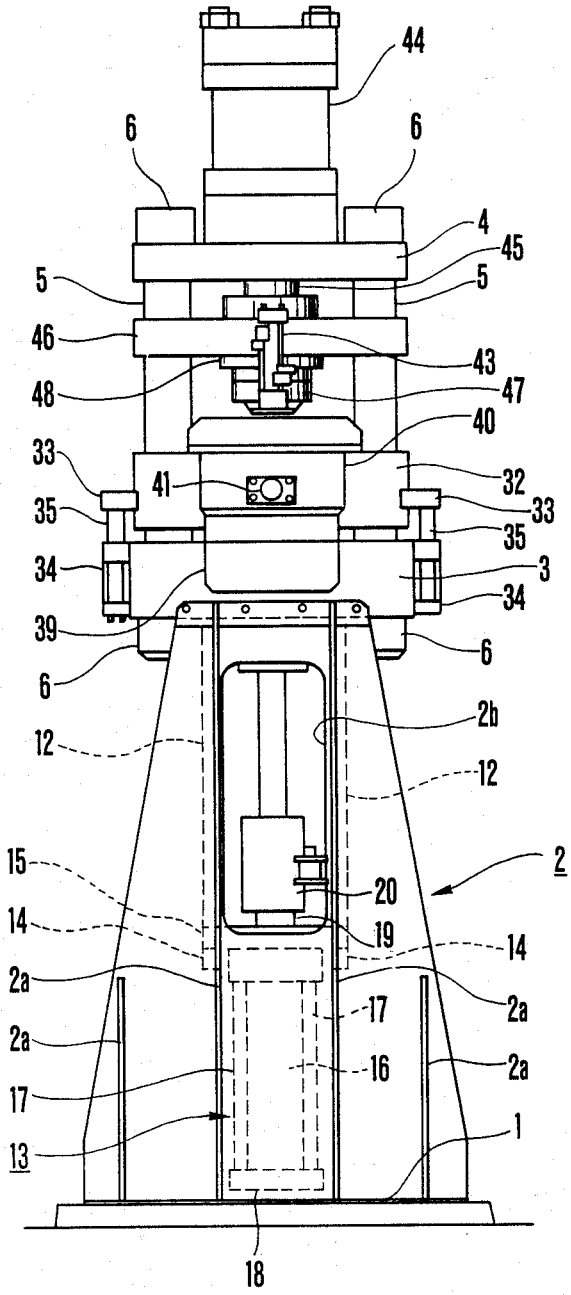
FIG. 2 is a front view of the apparatus.
Figure 7:
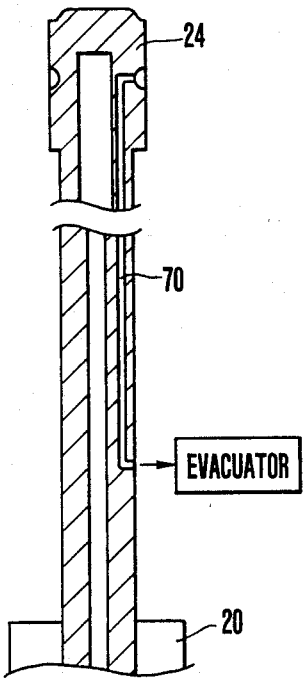
FIG. 7 is a fragmentary sectional view showing a plunger.

The present invention will be described in detail in connection with a preferred embodiment with reference to attached drawings. In this embodiment, there is illustrated an apparatus for impregnating molten matrix metal e.g. aluminum into a non-molten material exemplified as a porous body of fibrous materials such as silicon nitride fibers which will be called "whiskers" hereinafter. As shown in FIG. 2, a pair of stands 2 each having ribs 2*a* and an elongated hole 2*b* are installed on a base 1 on a floor surface. On the upper end thereof, a lower platen 3 is horizontally fixed by means of a plurality of bolts. An upper platen 4 is positioned above the lower platen 3. The lower and upper platens 3 and 4 are joined to each other by a pair of columns 5 and are securely fixed to each other by means of nuts 6 screwed on threaded upper and lower portions of the columns 5. As best seen from FIG. 1, a cylindrical hot molten metal container 7 serving as a molten metal retaining chamber has flanges 7*a* and 7*b* at its upper and lower portions, respectively. On the outer periphery thereof, a cylindrical heater 8 is fitted. The container 7 is secured to the central portion of the lower platen 3 through a cylindrical heat insulating material 9 and the vertical movement of the container 7 is prevented by the flange 7*a* and a lock ring 7*c*. On the flange 7*a*, a heater 11 is also fitted and shielded by a heat insulating material 10 from the atmosphere. Four tie rods 12 vertically extend through the lower platen 3 by being clear of the container 7 and are fixed to the lower platen 3 by means of nuts not shown. By these tie rods 12, a pressure applying cylinder, generally designated by reference numeral 13, is supported. The pressure applying cylinder 13 is provided with an upper platen 15 fixed to the lower portions of the tie rods 12 by means of nuts 14. A cylindrical cylinder body 16 is clamped by the upper platen 15 and a lower platen 18 joined to the upper platen 15 by means of four columns 17. Thus, the cylinder body 16 is securely fixed. A piston rod 19 associated with the pressure applying cylinder 13 is provided. The piston rod 19 moves upwardly or downwardly by a pressurized oil introduced into the cylinder body 16, and its operating end is housed in a half-splitted coupling 20. A plunger 22 joined to the piston rod 19 through a spacer 21 (FIG. 1) within the coupling 20 is aligned with the container 7 to extend upwardly and is moved upwardly or downwardly in synchronism with the upward or downward movement of the piston rod 19. Any rotational movement of the plunger 22 is prevented by a key 20*a*. As shown in FIG. 1, a plunger chip 24 mounted through an adapter 23 on the upper end of the plunger 22 is slidably fitted into an internal hole of the container 7. An air vent-ring 25 is screwed on a threaded lower end portion of the container 7 through a sealing member 26 and the plunger 22 is slidably supported by the vent-ring 25 via a sealing member 27. A water conduit 28 is provided in the central portion of a water feed hole 22*a* penetrating the axial center of the plunger 22. A pair of nozzles 29 and 30 inserted into the lower portion of the plunger 22 and connected to a water feed pump are opened to the water feed hole 22*a* and the water conduit 28, respectively. When water is fed to the nozzle 30 by the water feed pump, the water rises within the water conduit 28 to pass through a water cooled chamber 22*b* provided in the plunger chip 24 and the water feed hole 22*a* to return to the water feed pump via the nozzle 29, thus circulating for cooling the plunger 22. An annular air passage 31 formed between the air vent-ring 25 and the plunger 22 and a slight space defined by the plunger 22 rising into the container 7 and the inner wall of the container 7 are connected to an evacuator through a conduit 70 in the plunger 22, as shown in FIG. 7. A reduced pressure in these portions can balance with a reduced pressure discharged through a clamping device 47 to be described later.

The apparatus further comprises a container platen 32 slidably supported on the columns 5 so as to move upwardly and downwardly.

Figure 3:
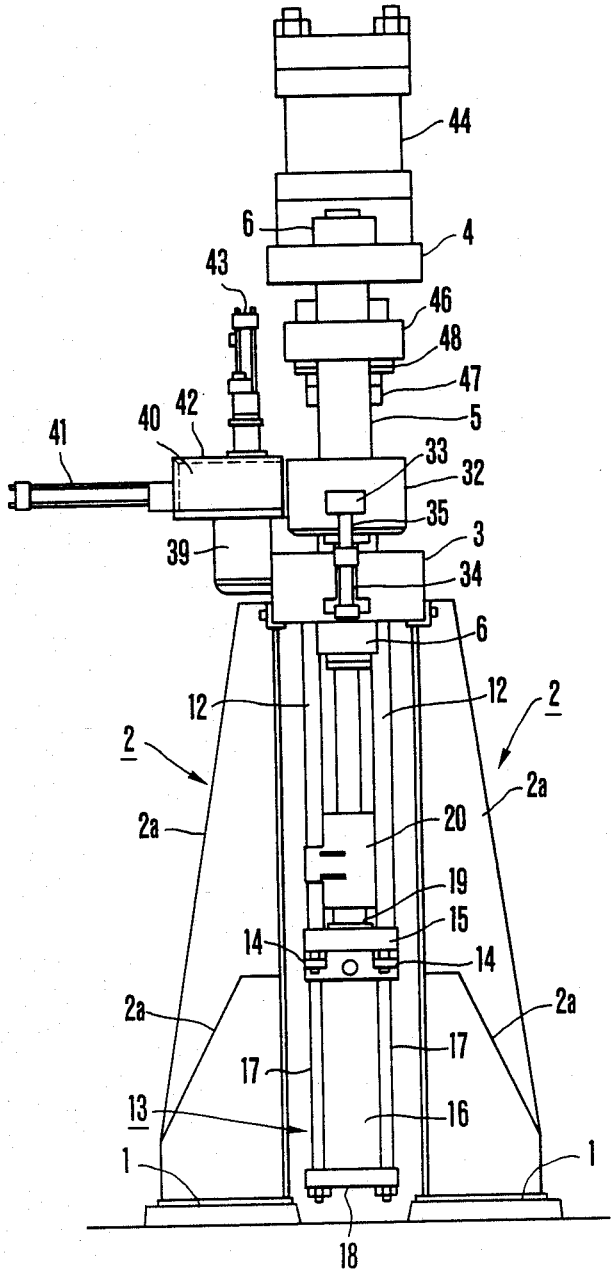
FIG. 3 shows a side view of the apparatus.

Operating ends of piston rods 35 of oil pressure cylinders 34 fixed to the opposite sides of the lower platen 3 are engageable with brackets 33 projecting from the opposite sides of the container platen 32. By supplying an oil into the cylinders 34 to advance or retract the piston rods 35, the container platen 32 can be moved upwardly or downwardly. As shown in FIG. 1, the container platen 32 is provided with a U-shaped container holder 32*a* whose inner peripheral surface is opened to the lefthand side in FIG. 3. A square flanged whisker container 36 having a circular hole 36*a* is held by the container holder 32*a* through a heater 37 and a heat insulating plate 38 fitted on the outer peripheral surface of the container 36. This container 36 can be mounted to or dismounted from the container holder 32*a* through the opening (lefthand in FIG. 3). The internal hole 36*a* of the whisker container 36 is chamfered at the upper and lower opening ends to form tapered surfaces 36*b* and 36*c* which, upon engagement, are snugly fitted to a tapered surface 50*b* of the clamping device 47 and a tapered surface 7*d* of the container 7, respectively. The chamfering is advantageous in that one tapered surface can strongly be pressed onto the other, thus preventing air from being admitted from the outside even when vacuum-evacuation is carried out and that exact centering can be ensured for the engaging members. The above-mentioned pair of oil pressure cylinders 34 are provided for releasing the engagement between the tapered surfaces 36*c* and 7*d* by raising the whisker container 36 together with the container platen 32, so that the whisker container 36 can be mounted to or dismounted from the container holder 32*a*. On the other hand, a bracket 39 is fixed to the lower platen 3, and a container box 40 opened to the whisker container 36 is integrally formed with the bracket 39. On the side surface of the container box 40, an oil pressure cylinder 41 for advance or retraction of the container is attached horizontally. The piston rod of the cylinder 41 extends within the container box 40 and its operating and slidably connects to the whisker container 36 in order not to disturb the vertical movement of the container 36. At the bottom portion of the container box 40, tracks are provided. By advancing or retracting the piston rod of the cylinder 41 by a pressurized oil, the whisker container 36 advances or retracts on the tracks so as to selectively takes either a position at which a whisker is loaded on container 36 within the container box 40 or conversely a product is taken off or a position at which hot molten metal is impregnated into the whisker. In the upper surface of the container box 40, a whisker charge port 42 is formed. An oil pressure cylinder 43 for knock down is elected on the upper surface. By lowering its piston rod by a pressurized oil, a product impregnated with the hot molten metal is pushed off downwardly of the whisker container 36.

Figure 4:
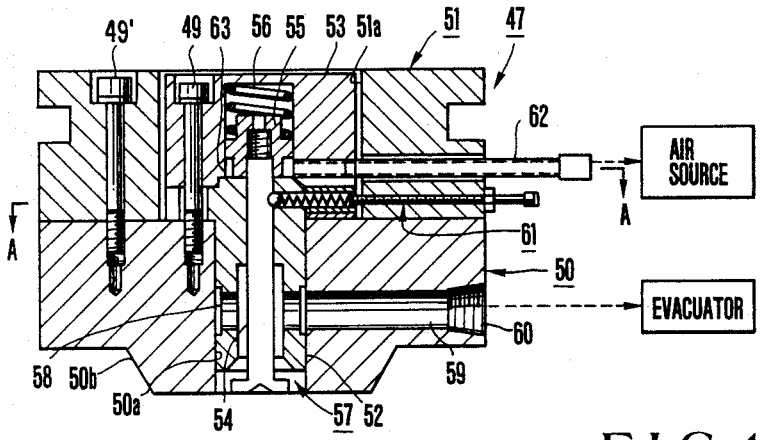
FIG. 4 is an enlarged longitudinal sectional view showing a clamping device employed in the apparatus.
Figure 5:
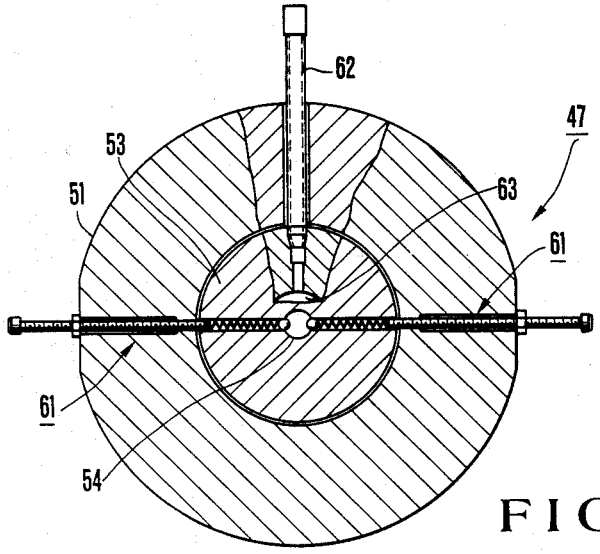
FIG. 5 is a cross-sectional view partly exploded and taken on line A—A in FIG. 4.

On the other hand, on the upper platen 4, a die clamping cylinder 44 is fixed with a piston rod 45 being directed downwardly. At the operating end of the piston rod 45, a moving platen 46 is attached movably in a vertical direction by being supported by the columns 5. On the lower surface of the moving platen 46, the clamping device, generally designated by reference numeral 47, is fixed by means of an annular fixing member 48. As shown in detail in FIGS. 4 and 5, the clamping device 47 has a body comprising a disk-shaped valve body 50 having two parts coupled by means of bolts 49' and 49, an annular mount block 51, a cylindrical valve guide 52 fitted into an internal hole **50*a* formed in the valve body 50, and a cylindrical head block 53 with a closed top which is fitted into an internal hole 51*a* formed in the mount block 51. On the lower portion of the valve body 50, the above-mentioned tapered surface 50*b* is formed. A valve 54 fitted into the valve guide 52 is movable in upward and downward directions. A threaded tip portion of the valve 54 is screwed into a threaded hole of a piston 55 provided at the upper portion of the valve guide 52. By a compression coil spring 56 interposed between the piston 55 and the closed top of the head block 53, the valve 54 is biased to open a valve seat 57 provided on its lower portion. Above the valve seat 57, an annular air passage 58 is provided in the valve guide 52. The air passage 58 is connected to an evacuator through an air passage 59 and a port 60 provided in the valve body 50. By activating the evacuator, a pressure prevailing above the non-molten material within the whisker container 36 is reduced. The clamping device 47 further comprises a click mechanism 61 provided with a ball pressed by a bolt and a spring and adapted to hold the valve 54 at an opened position thereof. The click mechanism 61 is configured so as to prevent the valve 54 from being closed while the pressure is being reduced through the port 60. The clamping device 47 further comprises a nozzle 62 inserted into the mount block 51 and opened to an air passage 63 around the piston 55. The nozzle 62 is connected to an air source to open or close the valve 54 by air. The pair of click mechanisms 61 are provided so that they are 180° out of phase as shown in FIG. 5. The nozzle 62 is 90° dephased relative to the click mechanism only for illustration purpose but actually, in phase with one of the click mechanisms 61. The clamping device 47 thus configured lowers together with the moving platen 46 to a position indicated by chained line in FIG. 1 to allow the tapered surface 50*b* to be urged against the tapered surface 36*b* of the whisker container 36 to thereby close the opening portion of the whisker container 36** in a airtight manner.

Figure 6:
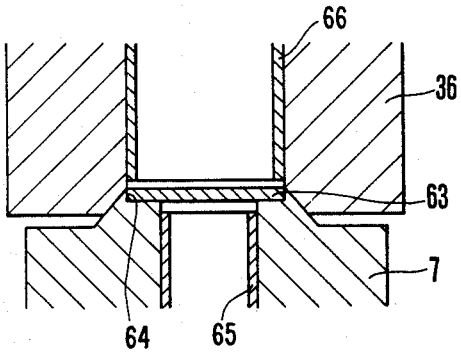
FIG. 6 is a schematic fragmentary view showing, in section, part of a molten metal container and a whisker container.

A method of impregnating molten metal with an apparatus for impregnating molten metal thus configured will be described. First is to insert or fill whiskers of ceramics comprising e.g. silicon nitride, at filling density of 20 to 30% necessary for the provision of a porous body, into the whisker container 36 positioned within the container box 40. The whisker used at this time is a fibrous non-molten material which is an extremely thin fiber having a length about ten times larger than a diameter, e.g., a diameter of 2 to 3 microns and a length of 20 to 30 microns, or a diameter of 10 microns and a length of 100 microns. The heat treatment applied to the whisker may be carried out with the whisker being accommodated within the whisker container 36. Alternatively, heat treatment may be applied to the whisker outside of the whisker container 36 in advance, and thereafter the heat treated whisker is accommodated within the whisker container 36. The heater 37 is heated up to about 450°. With the plunger 22 lowered, on the other hand, the heaters 8 and 11 provided in the hot molten metal container 7 are heated up to about 760° C. which is higher than the melting point of aluminum of 660° C., and thereafter hot molten aluminum is poured into the hot molten metal container 7. In such a case, the molten aluminum may of course be poured directly to the container 7. Alternatively, a relatively thin heat insulating sleeve 65 of e.g. ceramics is applied to or integrally formed with the inner peripheral surface of the hot molten metal container 7 as shown in FIG. 6 and hot molten metal is poured into the thus heat insulated container, thus making it possible to prevent lowering of temperature and oxidation of the hot molten metal. A ceramic heat insulating sleeve 66 may also be provided for the whisker container 36 as shown in FIG. 6 to attain the same effects for the whisker. It is required that the material for the heat insulating sleeves 65 and 66 does not generate gas under reduced pressure. Ceramics are preferred in this respect. Also, a material with flame spray coating of ceramics may be used for the same purpose. If a material which is liable to generate gas, such as asbestos, is used, the sleeve of this material applied to the inner surface of the container 7 or 36 is first heated by a heating device (not shown) so as to be degassed and thereafter the molten metal or the whisker body is introduced; or otherwise, this sleeve may be heated, on the outside of the apparatus, for degassing and subsequently, it may be placed in the container and the molten metal may be poured. In pouring the molten metal, a method as disclosed in U.S. patent application Ser. No. 508,810 of the same assignee (now patented as U.S. Pat. No. 4,505,307) may preferably be employed to prevent unwanted contacting of the molten metal with air. According to the pouring method, molten metal is first poured into a ladle having a molten metal discharge port at the bottom while the port is closed, a bottom portion of the ladle is then inserted into an injection sleeve (corresponding to the molten metal container of this invention), and the port is opened to commence to discharge the molten metal in the ladle into the injection sleeve, the ladle being inserted until a lower portion of the injection sleeve and raised while continuously discharging the molten metal such that the average raising speed is decreased as the level of the molten metal in the ladle decreases.

On the other hand, the piston rod 35 of the cylinder 34 is advanced and the container platen 32 is raised, so that the container holder **32*a* is at a height for reception of the whisker container 36. Thus, the piston rod of the oil pressure cylinder 41 is advanced to push the whisker container 36 into the container holder 32*a*. After the whisker container 36 is retained, the piston rod 35 of the oil pressure cylinder 34 is retracted and the container platen 32 is lowered, thus urging the tapered surface 36*c* of the whisker container 36 against the tapered surface 7*d* of the hot molten metal container 7. Subsequently, when the piston rod 45 of die clamping cylinder 44 is advanced to lower the moving platen 46, the clamping device 47 integral with the moving platen 46 is lowered to close the opening of the whisker container 36. Thus, the tapered surface 50***b* is urged against the tapered surface 36*b*. As a result, the upper and lower opening portions of both the containers 7 and 36 are airtightly closed by the clamping device 47 and the plunger 22. Accordingly, when the piston rod 19 of the pressure applying cylinder 13 is advanced, the plunger 22 joined to the piston rod 19 by means of the coupling 20 rises at a speed of, for example, 30 m/min to increase a pressure exerted on the hot molten metal below the whisker within the whisker container 36. By such an application of pressure, hot molten aluminum within the hot molten container 7 is transferred into the whisker container 36 and intruded into the space between the whiskers. Thus, the hot molten aluminum is impregnated into the whiskers. In such a pressure applying operation, air is introduced from the nozzle 62 into the air passage 63. Accordingly, the compression coil spring 56 is compressed by the piston 55 and the valve seat 57 is closed by the valve 54. Thus, the hot molten aluminum impregnated into the whiskers is solidified because the temperature within the whisker container 36 is about 450° C. which is less than the melting point. Next step is therefore to retract the piston rod 45 of the die clamping cylinder 44 to elevate the clamping device 47, and to lower the plunger 22 of the pressure applying cylinder 13. When the piston rod 35 of the cylinder 34 is advanced to elevate the whisker container 36 together with the container platen 32, the whisker container 36 is separated from the hot molten metal container 7. Accordingly, when the piston rod of the cylinder 41 is retracted, the whisker container 36 is transferred into the container box 40 along the tracks. Subsequently, when the piston rod of the cylinder 43 is advanced, a product within the whisker container 36 is pushed off downwardly.

In the above-mentioned embodiment, it has been described that a pressure required for impregnation is increased by means of the pressure applying cylinder 13. In addition to this method, by reducing a pressure prevailing above the whiskers without advancing the plunger 22, by reducing that pressure synchronously with the plunger advance, or by reducing that pressure and thereafter advancing the plunger, the impregnation can also be implemented. Where the pressure prevailing above the whiskers is reduced, first is to stop the introduction of air from the nozzle 62. As a result, the piston 55 lowers by the repulsive force of the compression coil spring 56 to cause the valve 54 to open the valve seat 57. Thus, under die clamped condition as previously mentioned, when air is evacuated by means of the evacuator through the port 60 of the clamping device 47, the pressure above the whiskers is reduced through air passages 59 and 58. Thus, hot molten metal can be impregnated into the whiskers without causing the plunger 22 to advance. In this instance, closure of the valve 54 can be prevented by fitting the ball of the click mechanism 61 into a recess provided in the valve 54.

Where the plunger 22 of the pressure applying cylinder 13 is raised to pressurize the molten metal while reducing that pressure, it is effective to evacuate air through the conduit 70 provided in the plunger 22 as shown in FIG. 7 by means of the evacuator. This is advantageous in that pressure balance between upper and lower sides of the whiskers at the time of impregnation can be adjusted. Namely, when only the pressure above the whisker is reduced via the port 60, the hot molten metal is sucked upwardly. As a result, an external air is admitted through a small gap between the outer peripheral surface of the plunger chip 24 and the hot molten metal container 7. For this reason, hot molten metal is bubbled or grained and then enters into the space between whiskers. In this case, there is a possibility dependent on sucking conditions that the hot molten metal sucked within the whisker container 36 is solidified before it is sufficiently filled within the entirety of the space between whiskers. But simultaneously evacuating air not only from the port 60 but also from the conduit 70 in communication with the annular air passage 31, vacuum conditions at both the portions can be balanced with each other and the hot molten metal will not rise. If the degree of vacuum at the upper portion (relative to the whisker) is slightly larger than the degree of vacuum at the lower portion, the hot molten metal rises to some extent. Therefore, it is preferred that the vacuum evacuating operation at the upper portion be initiated shortly after, example 0.1 to 1 second, preferably 0.3 to 0.5 seconds after the vacuum evacuating operation at the lower portion in order to eliminate possibility that the hot molten metal will rise, if the degree of vacuum at the lower portion is slightly smaller than the degree of vacuum at the upper portion. In this manner, a portion of the hot molten metal in contact with the plunger chip 24 can form a relatively thick and strong solidified layer which can prevent the suction of air from below, thus eliminating the possibility that the hot molten metal rises so abruptly as to bubble upon the vacuum evacuation from above. As stated above, while placing the hot molten metal in a condition that it does not rise, the vacuum evacuation is carried out from above to evacuate the interior of the whisker container 36 and thereafter the valve 57 is closed. Then, the hot molten metal is pushed into the whisker container 36 by utilizing the rising action of the plunger 22. It follows therefore that the hot molten metal is sufficiently filled within the entirety of the space between the whiskers and is more sufficiently impregnated. The vacuum evacuation valve provided in the clamping device may be replaced with a valve which is spontaneously closable in response to inertia force or pressing force of the molten material.

Further, in accordance with this embodiment, tapered surfaces 36*b* and 36*c* of the whisker container 36 formed inwardly. With this structure, the height of the whisker container 36 can be increased as compared to the case wherein outwardly tapered surfaces are formed, thus making it possible to increase the height of the heater 37 and consequently to improve heating conditions.

In the above-mentioned embodiment, ceramic whiskers are employed as non-molten material. In addition, spherical ceramics may also be used at small density to form a porous body. The substance constituting the non-molten metal is not limited to ceramics. Further, the substance constituting the molten material is not limited to aluminum.

Again turning to FIG. 6, between the upper end of the molten material retaining chamber 7 and the lower end of the non-molten material retaining chamber 36, a fine mesh or a filter plate 63 is provided which allows only molten material to pass therethrough but not to pass an oxide film occurring at the upper surface of the hot molten material therethrough. The filter plate 63 may be embedded within a recess 64 formed in the upper end of the chamber 7.

Figure 8A:
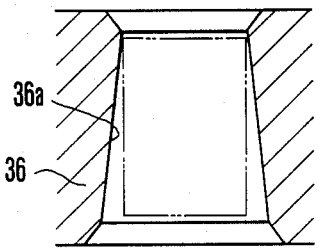
FIGS. 8A and 8B show details of an internal hole formed in the whisker container.
Figure 8B:
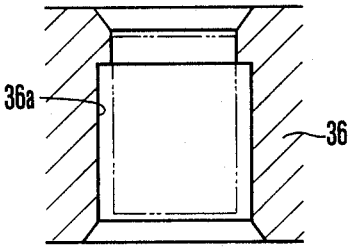

Preferably, as shown in FIGS. 8A and 8B, the diameter of the lower inlet of the whisker container 36 is made slightly larger, for example, about 2 mm larger than that of the upper outlet. Thus, the cylindrical porous body of whikers as designated at phantom line is placed in the hole 36*a*, defining a space between the body and the wall of the hole. Upon impregnation, the molten metal can penetrate into the body through not only the bottom surface but also the peripheral surface of the body, thereby improving efficiency of the impregnation.

As understood from the foregoing description, the apparatus for producing a compound material according to the present invention makes it possible to steadily integrate metal such as aluminum with high performance non-molten material such as ceramics, thus improving strength or heat-resisting property etc. of metal. In addition, the present invention can efficiently perform the above advantageous effects with the apparatus of a simplifed construction, thus producing products having uniform strength.

What is claimed is:

1. An apparatus for producing a reinforcement compound material comprising:

a first fixed platen horizontally supported by stand means erected on a floor, said first fixed platen having a vertical through hole at a center portion thereof;

a second fixed platen horizontally supported by a plurality of columns securely interconnecting respective outer portions of said first and second fixed platens;

a container platen horizontally disposed between said first and second fixed platens and having at a center portion thereof a U shaped through hole coaxial with the through hole of said first fixed platen and outer portions thereof slidably penetrated by said plurality of columns, said container platen being connected to said first fixed platen through driving means for lifting and retracting said container platen from and to said first fixed platen, respectively;

a whisker container mounter in the U shaped through hole of said container platen, said whisker container being attachable to and detachable from the U shaped through hole through an opened side of said U shaped through hole;

a clamping means having a clamping cylinder vertically secured to an upper central surface of said second fixed platen, a piston rod which vertically reciprocates within said clamping cylinder, slidably penetrates said second fixed platen and has a lower end fixed to an upper surface of said container platen, and an urging member fixed to a central portion of a lower surface of said container platen;

a sleeve member fixed to the through hole of said first fixed platen;

a first heater means attached to an outer surface of said sleeve member;

a first heat insulating means disposed between an inner surface of said first fixed platen and an outer surface of said sleeve member including said first heater means;

a second heater means attached to an outer surface of said whisker container;

a second heat insulating means disposed between an inner surface of said container platen and an outer surface of said whisker container including said second heater means;

a plunger means having a plunger tip at an upper end thereof slidably inserted into said sleeve member form below and moved upwardly and downwardly within said sleeve member by a plunger moving means;

a first retaining chamber formed of an inner surface of said sleeve member and an upper surface of said plunger tip for receiving a molten matrix metal;

a second retaining chamber formed in said whisker container to receive a reinforcement material selected from fibrous ceramics and spherical ceramics in the form of a porous body of low density;

vaccum evacuating means for vacuum evacuating interiors of said first and second retaining chambers, said vacuum evacuating means including a first air passage formed to pass through said urging member from said second retaining chamber, and a second air passage formed to pass from said first retaining chamber through a gap between an inner peripheral surface of said sleeve member and an outer surface of said plunger;

an upper surface of said sleeve member being engaged with the lower surface of said whisker container when said container platen is lowered by pressurizing said driving means, the upper surface of said whisker container being engaged with the lower surface of said urging member of said clamping means when said piston rod is lowered by pressurizing said clamping cylinder, such that said first and second retaining chambers communicate with each other to be sealed from an outer atmosphere, said molten metal being impregnated into said reinforcement matrix material by moving said plunger means upwardly to apply a pressure to said communicated first and second retaining chambers which are, meanwhile, vaccum evacuated by said vacuum evacuating means.

2. An apparatus for producing a reinforcement compound material according to claim 1 further comprising an air vent ring having an upper portion fixed to an outer lower end portion of said sleeve member and a bottom having a through hole which slidably contacts an outer peripheral surface of said plunger means, an air passage being formed between an inner peripheral surface of said air vent ring and the outer peripheral surface of said plunger means above the bottom of said air vent ring.

3. An apparatus for producing a reinforcement compound material according to claim 1 further comprising a container box mounted on a bracket fixed to said first fixed platen so that said whisker container is movable between said container platen and said container box.

4. An apparatus for producing a reinforcement compound material according to claim 3, wherein said reinforcement material is supplied to the second retaining chamber inside the container box, and the compound material produced is knocked down from said container box.

5. An apparatus for producing a reinforcement compound material according to claim 1, wherein said vacuum evacuating means comprises a valve means for opening and closing said first air passage.

6. An apparatus for producing the reinforcement compound material according to claim 1, wherein said sleeve member has at an upper and a lower end portions thereof a flange and a lock ring, respectively, to secure said sleeve member to said first fixed platen.

7. An apparatus as set forth in claim 1, wherein said molten matrix material is aluminum.

8. An apparatus as set forth in claim 1, wherein a filtering member allowing only said molten matrix material to pass there through is interposed between said first and second retaining chambers.

9. An apparatus as set forth in claim 1, wherein said sleeve member has upper and lower opening ends, with a diameter of said lower opening end being about two millimeters larger than that of said upper opening end.

10. An apparatus as set forth in claim 1, wherein a timing for vacuum evacuating the interior of said first retaining chamber is slightly earlier than a timing of vacuum evacuating the interior of said second retaining chamber.

* * * * *